US007123142B2

(12) United States Patent
Bohbot et al.

(10) Patent No.: US 7,123,142 B2
(45) Date of Patent: Oct. 17, 2006

(54) INTEGRATED INTERCOM AND SECURITY SYSTEM

(75) Inventors: Lucien Bohbot, New York, NY (US); Andrei Doilidov, Brooklyn, NY (US)

(73) Assignee: Unitone, New York, NY (US)

( * ) Notice: Subject to any disclaimer, the term of this patent is extended or adjusted under 35 U.S.C. 154(b) by 0 days.

(21) Appl. No.: 10/796,314

(22) Filed: Mar. 8, 2004

(65) Prior Publication Data

US 2005/0001717 A1 Jan. 6, 2005

Related U.S. Application Data

(60) Provisional application No. 60/453,157, filed on Mar. 6, 2003.

(51) Int. Cl.
*G08B 1/08* (2006.01)

(52) U.S. Cl. ..... 340/539.14; 340/539.11; 340/539.16; 340/286.01; 340/286.06

(58) Field of Classification Search ..... 340/539.11, 340/539.14, 539.16, 541, 542, 549, 286.01, 340/285.05, 286.06, 5.64; 379/37; 700/19, 700/20; 348/14.11
See application file for complete search history.

(56) References Cited

U.S. PATENT DOCUMENTS

| | | | | |
|---|---|---|---|---|
| 5,541,585 | A * | 7/1996 | Duhame et al. | 340/5.62 |
| 5,622,275 | A | 4/1997 | Citterio | 220/4.02 |
| 6,097,288 | A | 8/2000 | Koeppe, Jr. | 340/517 |
| 6,181,707 | B1 | 1/2001 | Erickson et al. | 370/442 |
| 6,535,110 | B1 * | 3/2003 | Arora et al. | 340/310.11 |
| 6,542,077 | B1 * | 4/2003 | Joao | 340/426.16 |
| 6,658,091 | B1 * | 12/2003 | Naidoo et al. | 379/37 |
| 6,720,861 | B1 * | 4/2004 | Rodenbeck et al. | 340/5.64 |
| 6,720,874 | B1 * | 4/2004 | Fufido et al. | 340/541 |
| 6,930,604 | B1 * | 8/2005 | Marino | 340/539.16 |

* cited by examiner

*Primary Examiner*—Van T. Trieu
(74) *Attorney, Agent, or Firm*—Ostrolenk, Faber, Gerb & Soffen, LLP

(57) ABSTRACT

An integrated intercom and security system including a local integrated intercom and security system and a remote communication in communication with the local intercom and security system via a globally accessible communication network.

22 Claims, 10 Drawing Sheets

INTEGRATED INTERCOM AND SECURITY SYSTEM

RELATED APPLICATION

This application is based on and claims benefit of U.S. Provisional Application No. 60/453,157, filed on Mar. 6, 2003, entitled Security System, to which a claim of priority is hereby made.

BACKGROUND AND SUMMARY OF THE INVENTION

The present invention relates to an integrated intercom and security system.

Known intercom systems for a housing complex such as an apartment building include, for example, a number of user interfaces for audio communication with an intercom panel that is typically installed at a threshold point, e.g. the front door to the building. Such a system may be also equipped with a security system which allows the user inside the building to operate a lock from a remote location in order to allow the threshold (e.g. the front door) to open.

Other known systems may include, among other features, a feature for visually viewing the area at the vicinity of the threshold for positive identification of, for example, a visitor.

It is an object of the present invention to provide an enhanced intercom and security system.

An integrated intercom and security system according to the present invention includes a local integrated intercom and security system and a remote communication unit which can be in real time communication with the local integrated intercom and security system via a globally accessible communication network such as the Internet.

The local integrated intercom and security system according to the present invention includes a plurality of user interfaces in communication with a central communication unit. Each user interface is associated with a respective user. For example, a user interface may be associated with a tenant residing at a given apartment within a housing complex. A user interface in a system according to the present invention may include a two-way audio communication system, a visual display, and a control panel that enables the user to execute functions within the system. For example, the control panel may include a key for sending preselected messages to the central communication unit.

The local integrated intercom and security system further includes an electro-mechanically operable lock system and an integrated keyless entry system. The electro-mechanically operable lock system operates to allow access through a threshold, for example, a front door, and can be operated from any one of the user interfaces, the central communication unit, or by the integrated keyless entry system.

According to one aspect of the present invention the central communication system includes a memory that stores a list of all users and associated information as well as any information necessary for enabling keyless entry for users. The information so stored may be updated at the central communication unit. In addition, selected portions of the user information stored at the central communication unit may be displayed to the public via an electronic display. Thus, for example, a publicly accessible display panel may be installed outside the residential complex which can be viewed by the public.

According to an aspect of the present invention only the names of the users are displayed, and the unit numbers (e.g. apartment numbers) associated with each user are not displayed. Such a feature enhances the privacy and the security of users.

According to another aspect of the present invention the information stored at the central communication unit may be updated from the remote communication unit. The latter function allows for central control over the security of the building from a remote location. Additionally, the remote communication unit can be used to perform diagnostics on all of the equipment within the local integrated intercom and security system.

The following is a list of additional features in a preferred embodiment of the present invention:

1) feature that allows a user to view images from more than one zone within the residential complex;

2) feature that allows a user to have an automatic view of a visitor entering the building when the door is opened;

3) feature that allows the operator of the central communication unit to send text messages to a selected user or a selected group of users;

4) feature in the user interface that is capable of storing text messages for future viewing;

5) feature that allows a user to send a message to the operator of the central communication unit;

6) feature that allows an operator of the central communication unit to transmit an audio message to a selected user interface or a selected group of user interfaces;

7) feature that allows a user to establish audio communication with the operator of the central communication unit;

8) wireless peripheral sensors such as an intruder alarm or a smoke detector associated with a user interface that can be monitored by the central communication unit or the remote communication unit;

9) access by remote communication unit to send text message to, view text messages stored at or delete text messages from any one of or any selected group of user interfaces;

10) video messaging.

In addition, a system according to the present invention allows the central communication unit to communicate with user interfaces through the riser controllers. This feature allows for a greater number of user interfaces, the ability to disconnect a failed riser, the ability to switch a number of audio and video channels, and the ability to communicate with the sensors such as the smoke detectors and/or intruder alarms in the system.

Other features and advantages of the present invention will become apparent from the following description of the invention which refers to the accompanying drawings.

DETAILED DESCRIPTION OF THE EMBODIMENT

Figure 1A:
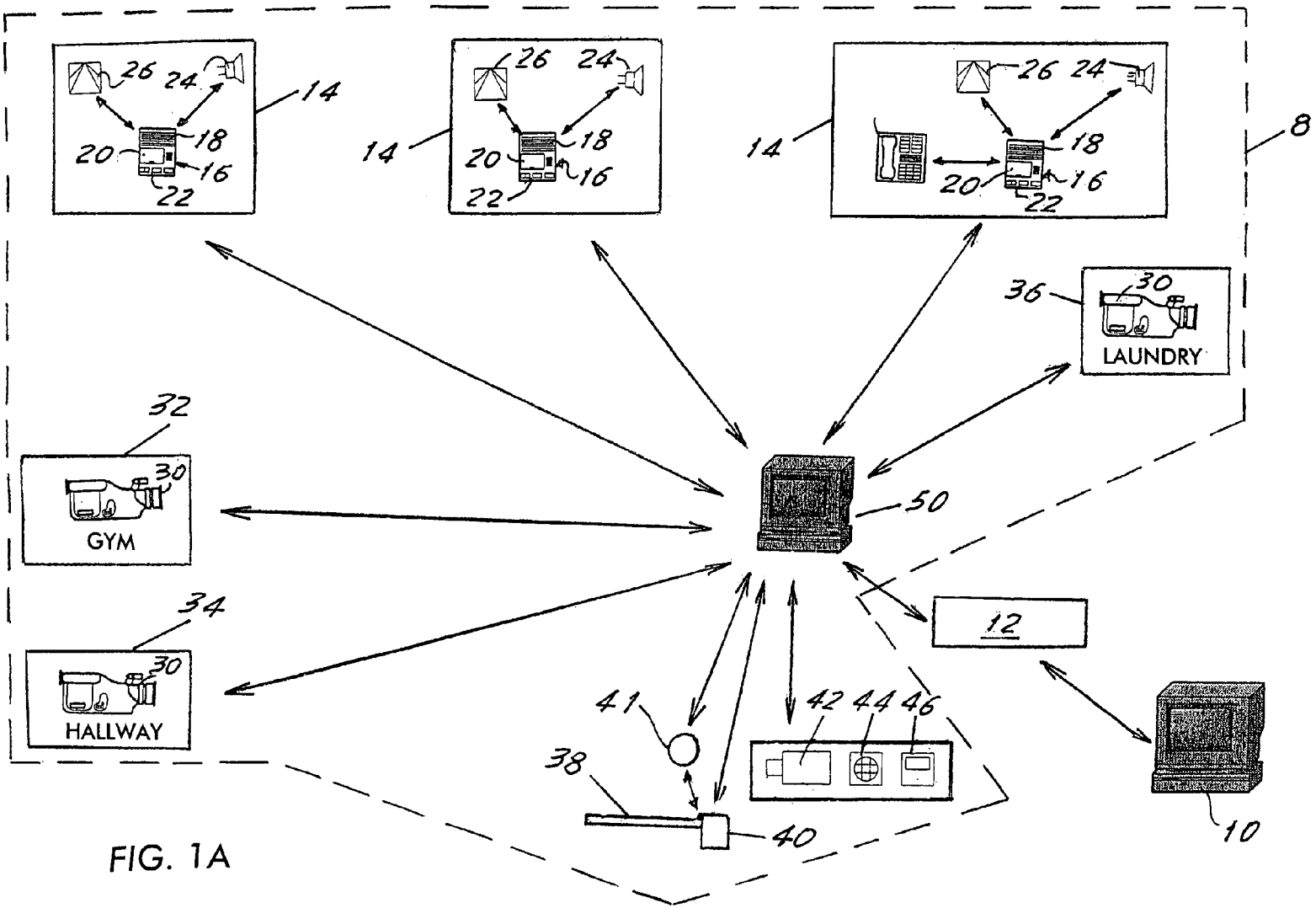
FIG. 1A shows schematically an integrated intercom and security system according to the present invention.

Referring to FIG. 1A, an integrated intercom and security system according to the present invention includes local integrated intercom and security system 8 and a remote communication unit 10. Remote communication unit 10 may be a personal computer which is in real time communication with local integrated intercom and security system 8 via a globally accessible communication network 12 such as the Internet.

In the preferred embodiment of the present invention, local integrated intercom and security system 8 is adapted for use in a multi-family residential housing complex such as an apartment building. It will be understood by a person skilled in the art that the present invention is not limited to use for a residential housing complex, but that it can be adapted for use in a commercial or otherwise non-residential environment.

In the preferred embodiment of the present invention, a plurality of residential units 14 in the residential housing complex are equipped at least with a user interface 16. It should be noted that the present invention is not limited to one user interface, but a plurality of user interfaces may installed in the same residential unit 14. Thus, if residential unit 14 is a large apartment, such as a duplex, a plurality of user interfaces 16 may be installed at various locations for enhanced convenience of the user.

In the preferred embodiment of the present invention, each user interface 16 includes at least a two-way audio communication system 18, a keyboard panel 22, a visual display 20 such as an LCD, and a programmable logic unit (not shown).

According to an aspect of the present invention, each two-way audio communication system 18 may be a hands-free audio system which is capable of sending and receiving audio signals simultaneously without a need for manual interference by the user.

In the preferred embodiment of the present invention, each user interface includes a single Talk key 22A. According to an aspect of the present invention a user can begin operating two-way audio communication system 18 by pressing and releasing Talk key 22A, and then speaking and listening to audio signals without further manual intervention (i.e. without manipulating any other key). This feature is unlike prior art designs of residential intercom audio systems in which the user must press down and hold one key to listen to audio signals and then another key to transmit audio signals.

In one embodiment of the present invention each user interface may be constructed modularly. Thus, instead of an integrated unit, each user interface 16 may be constructed with several detachable modules. Such an embodiment enables the user to customize his/her user interface 16 by changing one module within the user interface 16 instead of having to replace the entire user interface 16 unit. For example, keyboard panel 22 may be a module which can be disconnected from a user interface 16 and replaced with another keyboard panel 22 having the same or improved functionality.

Figure 2A:
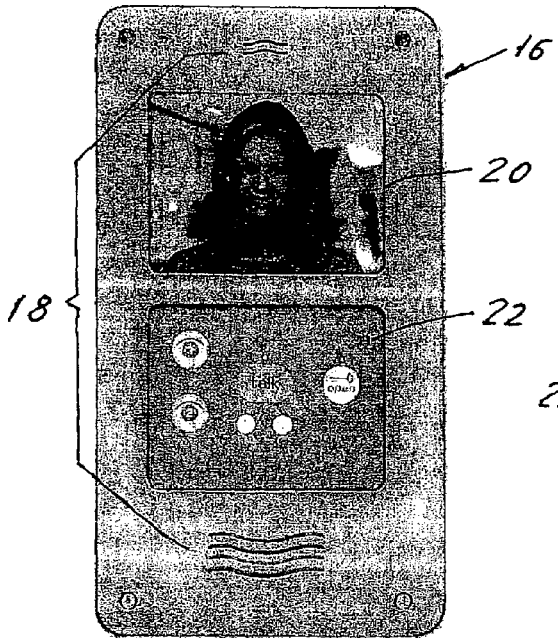
FIG. 2A shows a first example of a user interface according to the present invention.
Figure 2B:
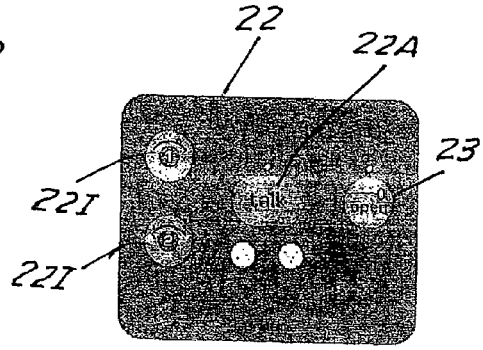
FIG. 2B shows a keyboard panel as used in the first example of the user interface shown in FIG. 2A.
Figure 3A:
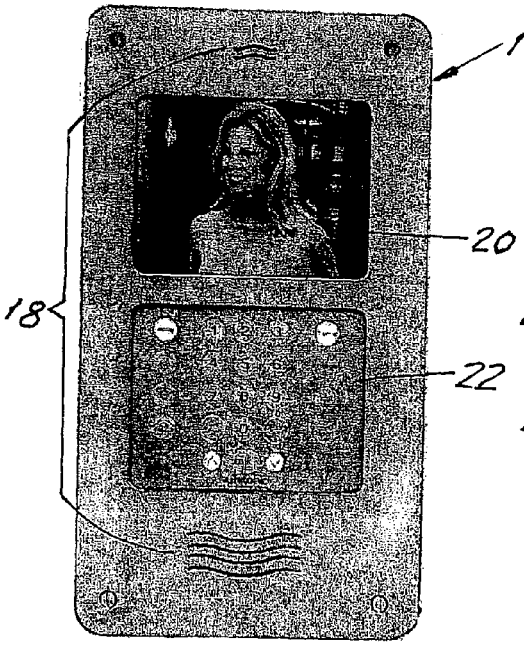
FIG. 3A shows a second example of a user interface according to the present invention.
Figure 3B:
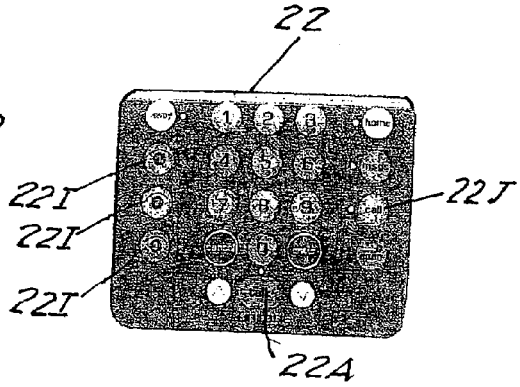
FIG. 3B shows a keyboard panel as used in the second example of the user interface shown in FIG. 3A.

Referring, for example, to FIGS. 2A and 2B, a user interface 16 may include keyboard panel 22 module, visual display 20 module and two-way audio communication system 18 module.

Now referring to FIGS. 3A, 3B, 4A and 4B, a modular keyboard panel 22 may be devised to include a variety of function keys, thereby allowing a user to expand or reduce the functional aspects of a user interface without the need for replacing visual display 20 or two-way audio communication system 18. As a result one keyboard panel 22 may be exchanged with another keyboard panel 22 which includes keys for the performance of different functions.

Figure 4A:
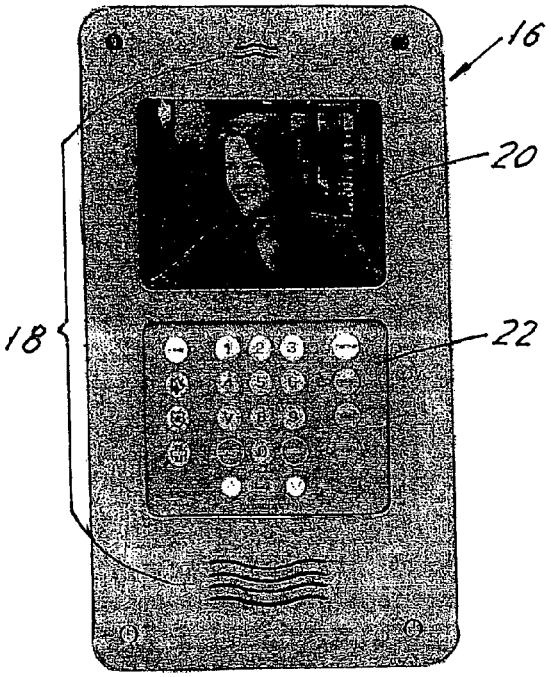
FIG. 4A shows a third example of a user interface according to the present invention.
Figure 4B:
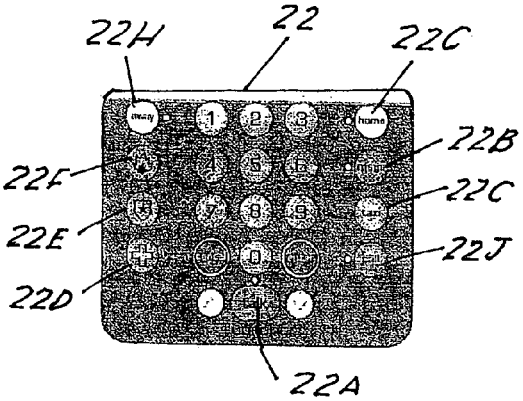
FIG. 4B shows a keyboard panel as used in the third example of the user interface shown in FIG. 4A.

According to an aspect of the present invention a modular keyboard panel 22 of a user interface 16 is operatively connected to a programmable logic unit (not shown). The programmable logic unit is capable of being programmed so that it can perform the functions assigned to each key on a keyboard panel 22. Thus, for example, a keyboard panel 22 may include a key for sending a request for taxi service 22 (FIG. 4B), while another keyboard panel may not. When the former keyboard panel is used, the programmable logic unit (not shown) may be programmed to respond to the key for taxi service 22C (FIG. 4B).

Figure 5:
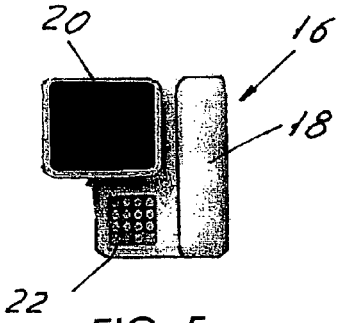
FIG. 5 shows a fourth example of a user interface according to the present invention.

It should be noted that in the embodiments shown in FIGS. 2A–4B two-way audio communication system becomes operable when Talk button 22A is pressed once by the user. A system according to the present invention, however, is not limited to such a configuration. As, for example, shown in FIG. 5 two-way audio communication system 18 may be a standard hand-set such as the ones used with conventional telephones.

Figure 1B:
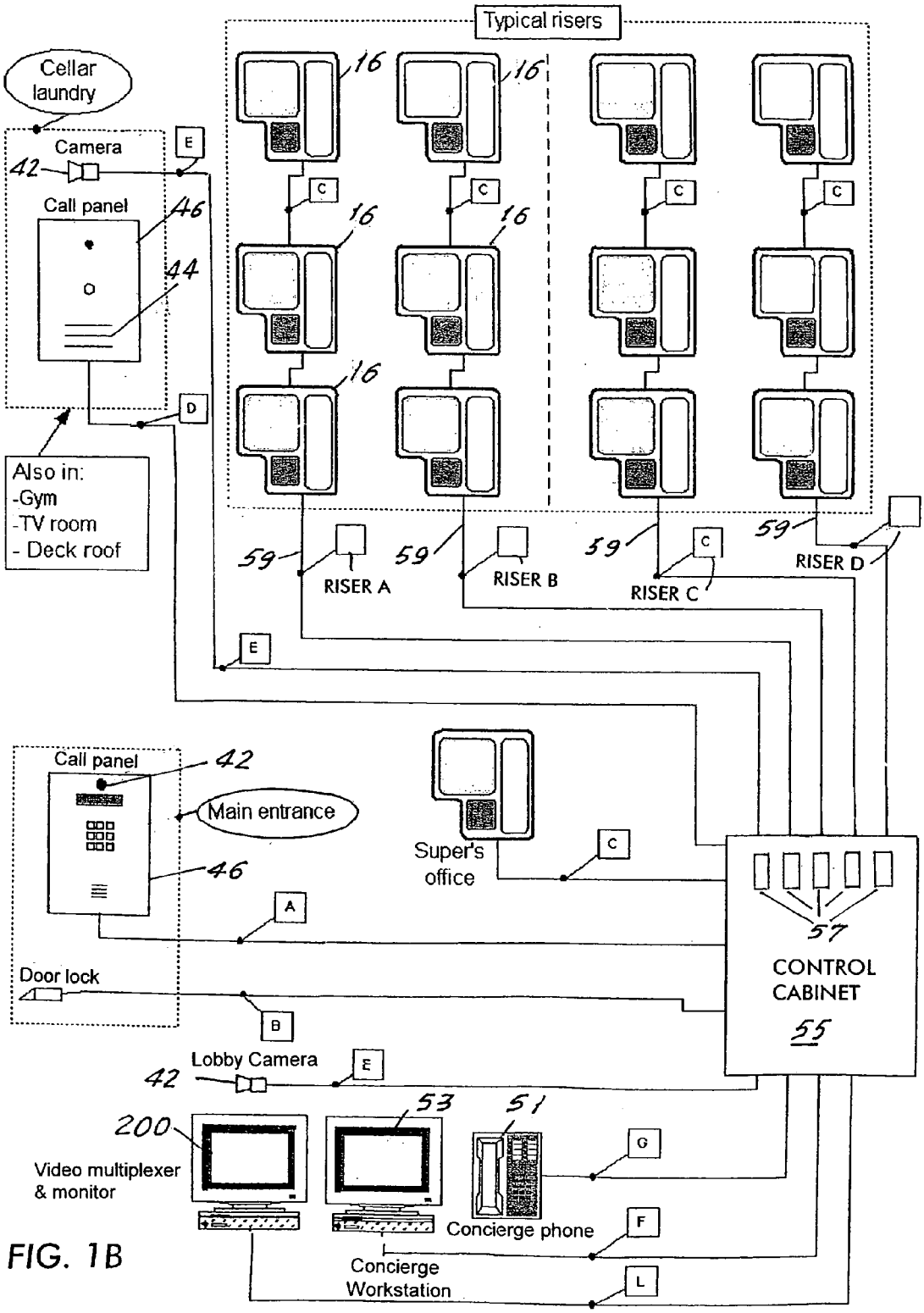
FIG. 1B shows schematically an alternative embodiment of a system according to the present invention.

Referring again to FIG. 1, in the preferred embodiment of the present invention, a user interface 16 may be in communication with a peripheral device. For example, a user interface 16 may be in communication with a smoke detector 24 and/or an intruder alarm 26. In the preferred embodiment of the present invention, the peripheral devices are wirelessly connected to respective user interfaces 16. However, peripheral devices may also be wired into user interface 16.

In an alternative embodiment, a user interface 16 may be in communication with a conventional telephone 28. Thus, a user may be able to respond (e,g. respond to the door bell) without having to walk to the location of user interface 16.

A system according to the preferred embodiment of the present invention further includes a plurality of surveillance cameras 30. Each surveillance camera 30 is disposed in a zone within the residential housing complex. A zone, for example, may be a gym 32, a hallway 34, or a laundry room 36. Other possible zones may be, for example, a playground for the residential complex, or a front desk area. A user may view each of these zones by pressing the appropriate zone key 22I on keyboard 22.

A system according to the present invention further includes a front door 38 which is equipped with a conventional electro-mechanical locking system 40. Electro-mechanical locking system 40 can be operated from a remote location (e.g. a residential unit 14) to open a lock that keeps front door 38 inaccessible. Thus, a user may be able to operate electro-mechanical locking system 40 from any one of user interfaces 16 to open front door 38. Preferably, each control panel 22 is equipped with a manual feature (e.g. open key 23, FIG. 2B) which sends a signal to electro-mechanical locking system 40 in order to release the lock and allow front door 38 to be opened.

Electro-mechanical lock system 40 may be further equipped with a conventional keyless entry system 41. Such systems typically permit a user to employ an activating device to operate electro-mechanical lock system 40 to enter the building. A typical activating device may be an electronically readable card which is recognized by keyless entry system 41. Such activating devices may be deactivated by instructing keyless entry system 41 to refuse access to a particular activating device. Thus, effectively an activating device may be deactivated and rendered incapable of opening keyless entry system 41.

According to an aspect of the present invention keyless entry system 41 is operatively integrated as part of the system, as opposed to being a free-standing system that operates independent from the other parts of the system. It should be noted that keyless entry may be extended to other zones within the housing complex such as, for example, the gym, or laundry room.

A system according to the present invention further includes front door surveillance camera 42, front door audio intercom unit 44, and front door electronic directory 46, all installed near front door 38.

Front door surveillance camera 42 collects images from the vicinity of front door 38. The images collected from the vicinity of front door 38 are then transmitted so that they may be viewed at any one of visual displays 20 (see e.g., FIG. 2A).

Front door audio intercom unit 44 is preferably a conventional two-way communication device which can transmit and receive respectively audio signals to and from an audio communication system 18 whereby a user (e.g. a tenant) may communicate with another user (e.g. visitor) at the vicinity of front door 38.

Front door electronic directory 46 is capable of displaying the names of users of each user interface 16. For example, in the preferred embodiment of the present invention, the names are tenants in each residential unit in the residential complex.

Figure 6:
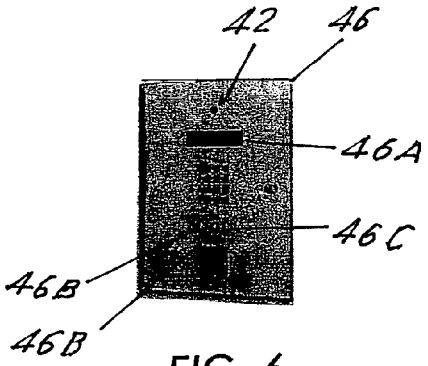
FIG. 6 shows an example of an electronic directory that may be used in a system according to the present invention.

An example of an electronic directory 46 is shown in FIG. 6. As shown in FIG. 6, electronic directory 46 includes, for example, an electronic display 46A for showing information related to users (e.g. tenants in a residential complex), scroll keys 46B. Scroll keys 46B can be used to scroll up/down the list of users (e.g. tenants).

According to one aspect of the present invention, electronic display 46A only displays the names of the users (e.g. tenants), and does not identify the unit number (e.g. apartment number). Such a feature provides enhanced privacy and security for the users of the system. Thus, an intruder could not determine which apartment is occupied and which apartment is not occupied by simply pressing a key and waiting for a response.

Referring back to FIG. 1, a system according to the present invention further includes central communication station 50. In the preferred embodiment of the present invention central communication station includes a telephone 51, a conventional PC 53, and central communication interface 55.

Central communication interface 55 is preferably a motherboard which has installed thereon a plurality of electronic bridges 57. According to an aspect of the present invention each bridge is assigned to and associated with a group of residential units 14. For example, each electronic bridge 57 can be assigned to a column of apartments (hereafter referred to as a riser) and can serve as the electronic conduit between conventional PC 53 and user interfaces 16 in that riser. To be more specific, in, for example, residential towers, each riser is assigned a designation. For example, in a high rise building there may be a riser A, a riser B, and riser C. Each riser includes a group of vertically adjacent apartment units 14.

According to an aspect of the present invention, each electronic bridge 57 is dedicated to one riser so that when a failure occurs in one riser, the entire system is not affected.

According to an aspect of the present invention, there is one communication backbone 59 for each riser in a building. Each user interface 16 in a riser can be connected directly to communication back bone 59 and placed in communication with central communication unit 50. Such an arrangement allows for the easy expansion of the system as user interfaces 16 can be added with ease without modification of the system as a whole.

Central communication unit 50 is in communication with all user interfaces 16, cameras 30 in each zone, front door surveillance camera 42, electro-mechanical locking unit 40, keyless entry system 41, intercom unit 44, and electronic directory 46. In the preferred embodiment, communication between the various parts of the system is conducted employing RS 485 communication standard as a physical layer. The invention is not limited to such a standard, and other communication methods can be employed without deviating from the present invention.

According to an aspect of the present invention, central communication station 50 is in real time communication with remote communication unit 10 via a globally accessible communication network 12, such as the Internet.

Central communication unit 50 may include one or more visual displays 200 whereby a user such as a doorman, or concierge may view images from cameras 30, and surveillance camera 42. Central communication station 50 may also be equipped with audio equipment for audio communication with each audio unit 18 and intercom 44.

Figure 8:
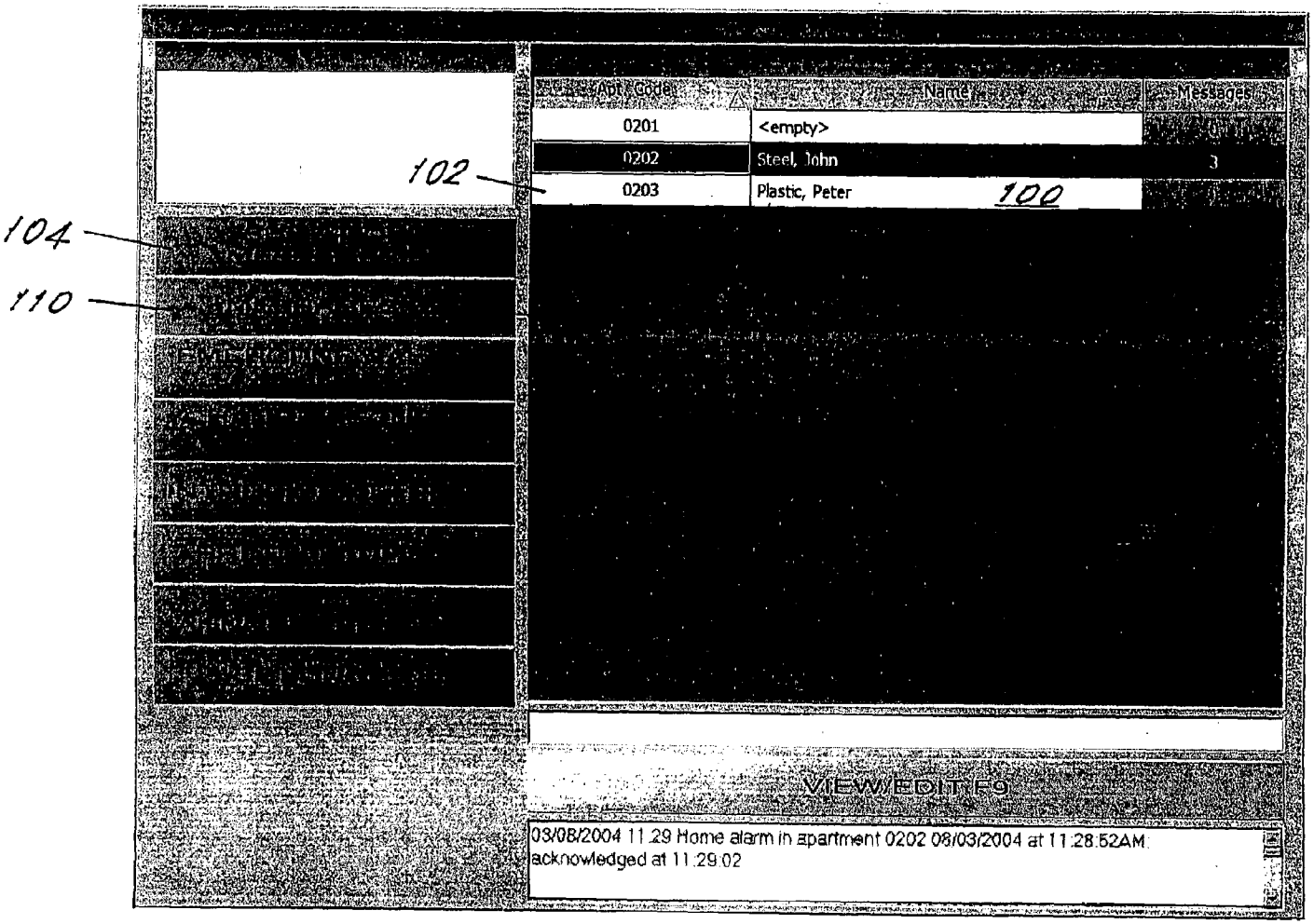
FIGS. 8–13 show examples of graphical user interfaces that may be used to communicate information and messages in a system according to the present invention.

Referring to FIG. 8, according to one aspect of the present invention PC 53 includes a listing of all users (e.g. tenants). The listing is accessible by an operator of central communication unit 50. Thus, as shown in FIG. 8, the name of a user 100, a residential unit number 102 associated with the user can be displayed by a visual display unit (e.g. monitor) operatively connected to PC 53.

According to one aspect of the present invention, more than one user name 100 can be associated with a residential unit number 102. Thus, for example, the names of two or more roommates may be associated with one unit number 102. This feature allows a visitor to be able to make contact with a user in a residential unit 14 without having to know any other user in the same unit. Thus, in the situation involving roommates, a visitor does not need to know the name of all roommates, only the name of the user he wishes to see.

When a visitor enters the a residential complex equipped with a system according to the present invention, he may first approach the operator of central communication unit 50 and request to see a particular user, for example, Mr. Peter Plastic. Using the information stored within PC 53, the record associated with user Peter Plastic is obtained by the operator of central communication unit 50. PC 53 thus may include a software function for sorting through the listing of users to find the requested user, e.g. Peter Plastic.

Once the desired user is found, his name is highlighted. Thus, if a visitor asks for Peter Plastic, the operator of central communication unit 50 first sorts through the listing of users to find Peter Plastic's record and then highlights the record.

According to one aspect of the present invention once the desired user is found and highlighted the operator of central communication unit 50 can pick up the handset of telephone unit 51 that is integral with PC 53 and dial a single key, such as the star key, on the keyboard of telephone 51. According to an aspect of the present invention, once the key is pressed the information in the record of the selected user is employed to make contact with the user interface 16 associated with the selected user's residential unit. As a result of the automation, the operator of central communication unit 50 can make contact with a user with a single touch, unlike the prior art method which required the dialing of residential unit number.

Once an operator performs the single touch operation as described above, an audio generator in user interface 16 generates an audio signal (e.g. a door bell signal) and the video image of the visitor is transmitted to visual display unit 20 of selected user's user interface 16. It should be noted that the visitor's image is captured by a surveillance camera 42 installed near the vicinity of the operator of central communication unit 50.

According to an aspect of the present invention, the selected user need not take any action prior to receiving the image of the visitor. Advantageously, therefore, the user may view the image before deciding whether to respond. As a result, the selected user can avoid having to disclose whether he/she is home.

If the selected user decides to respond, he/she can simply press and release the Talk key 22A to open two way audio communication with the operator of central communication unit 50.

It should be noted that a system according to the present invention can be operational without an operator of central communication unit 50. In such a system, for example, a visitor would select a user using electronic directory 46, and press a contact key 46C to begin the process for making contact with the selected user. In this example, a video image of the visitor would be transmitted through surveillance camera 42 to the visual display 20 of the user interface 16 associated with the selected user. As described before, the user after observing the video image may decide whether to establish two-way audio communication by pressing Talk key 22A, allow the visitor inside by pressing Open key 23, or just ignore the attempt at establishing the contact.

According to one aspect of the present invention the following happens when an attempt to establish communication takes place. First, PC 53 sends a request to establish communication with the selected user's user interface 16. Thus, for example, PC 53 would send a request to residential unit 0203 in order to establish communication with the user interface 16 associated with Peter Plastic. In the example shown in FIG. 8 the first two digits identifying the riser number in which the residential unit 0203 is located, and two digits identify the residential unit in that riser. Thus, number 0203 identifies residential unit number 03 in riser 02.

Using the riser number, PC 53 makes initial contact with an electronic bridge 57 associated with that the riser number (e.g. electronic bridge 57 associated with riser 02). Electronic bridge 57 then uses the residential unit number (e.g. 03) to send a request for contact with the user interface 16 in that residential unit. The user interface then either responds with a signal to accept the request, does not respond, or denies request. When a request for contact has been accepted by user interface 16, the acceptance is forwarded to PC 53 by electronic bridge 57. Thereafter, communication between PC 53 and user interface 16 is established, thus allowing for a signal to be sent to user interface 16 to sound off the sound generator to grab the attention of the user. It should be understood that the foregoing protocol is not critical, and that other communication protocols may be employed to establish communication between PC 53 and a user interface 16 within the system.

According to one aspect of the present invention, central communication station 50 includes a feature for sending and receiving messages from one or a selected group of user interfaces 16.

The preferred embodiment of the present invention includes a feature for sending pre-composed messages and a feature for composing and sending messages.

Figure 7:
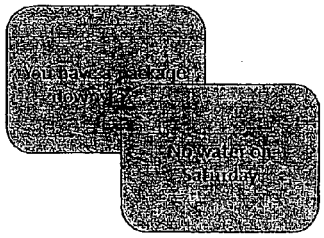
FIG. 7 illustrates two examples of text messages that can be sent to users of a system according to the present invention.
Figure 9:
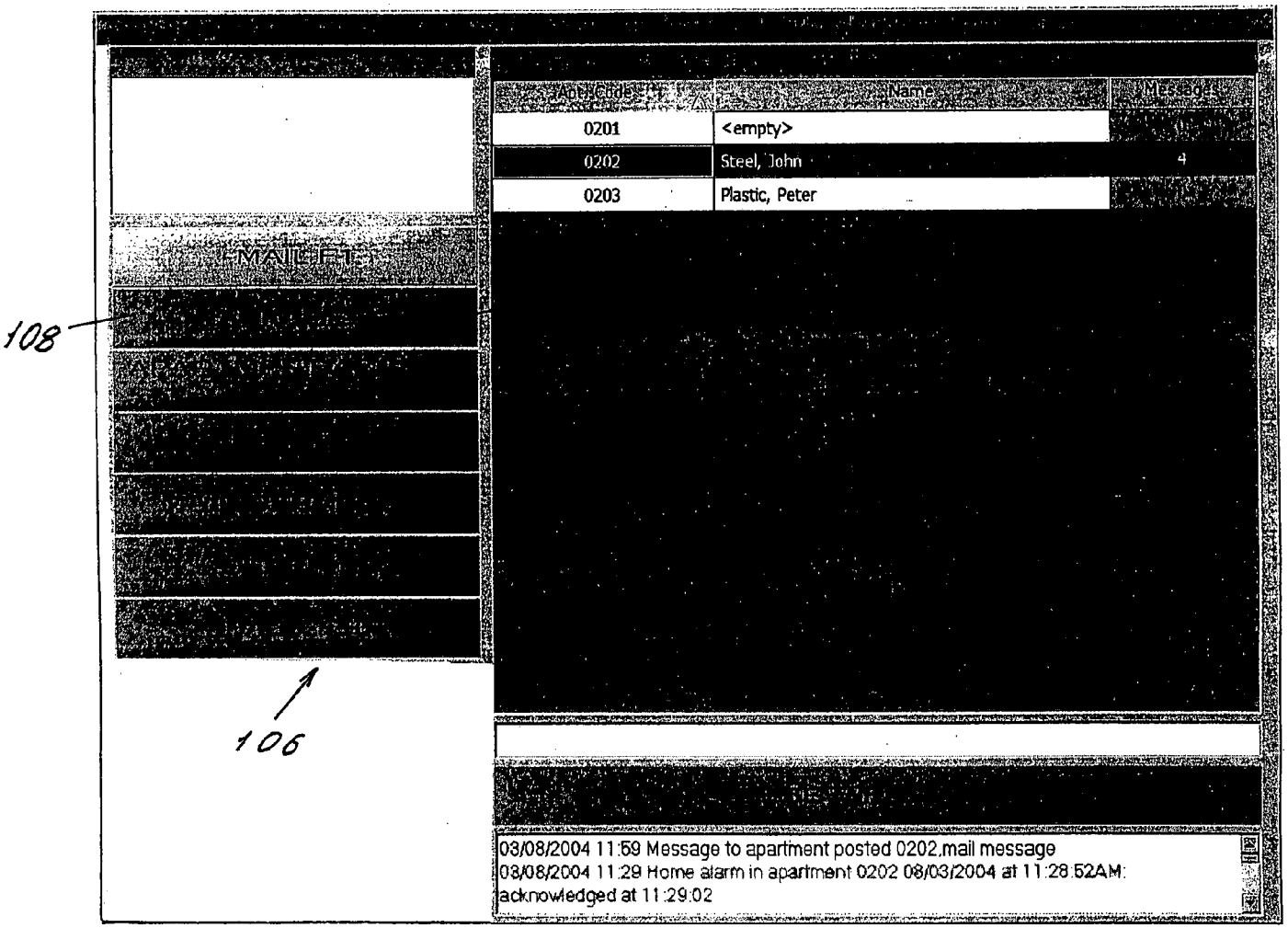

Thus, in the preferred embodiment, by clicking on Short-Cut Message button 104 (or by pressing the F1 key on the keyboard of PC 53), a listing 106 of titles of pre-composed messages are provided to the operator of central communication unit 50 as shown in FIG. 9. By clicking on any one of the pre-composed messages a pre-composed text message is sent to a selected user. For example, an operator of central communication unit may select John Steel by highlighting his name, click on Short-Cut Messages button 104 or F1, and then click on Package button 108 or F2 to send a pre-composed message to the user interface associated with John Steel. Referring for example, to FIG. 7, the pre-composed message "You have a package downstairs" will appear on the visual display 20 of the user interface associated with John Steel.

Figure 10:
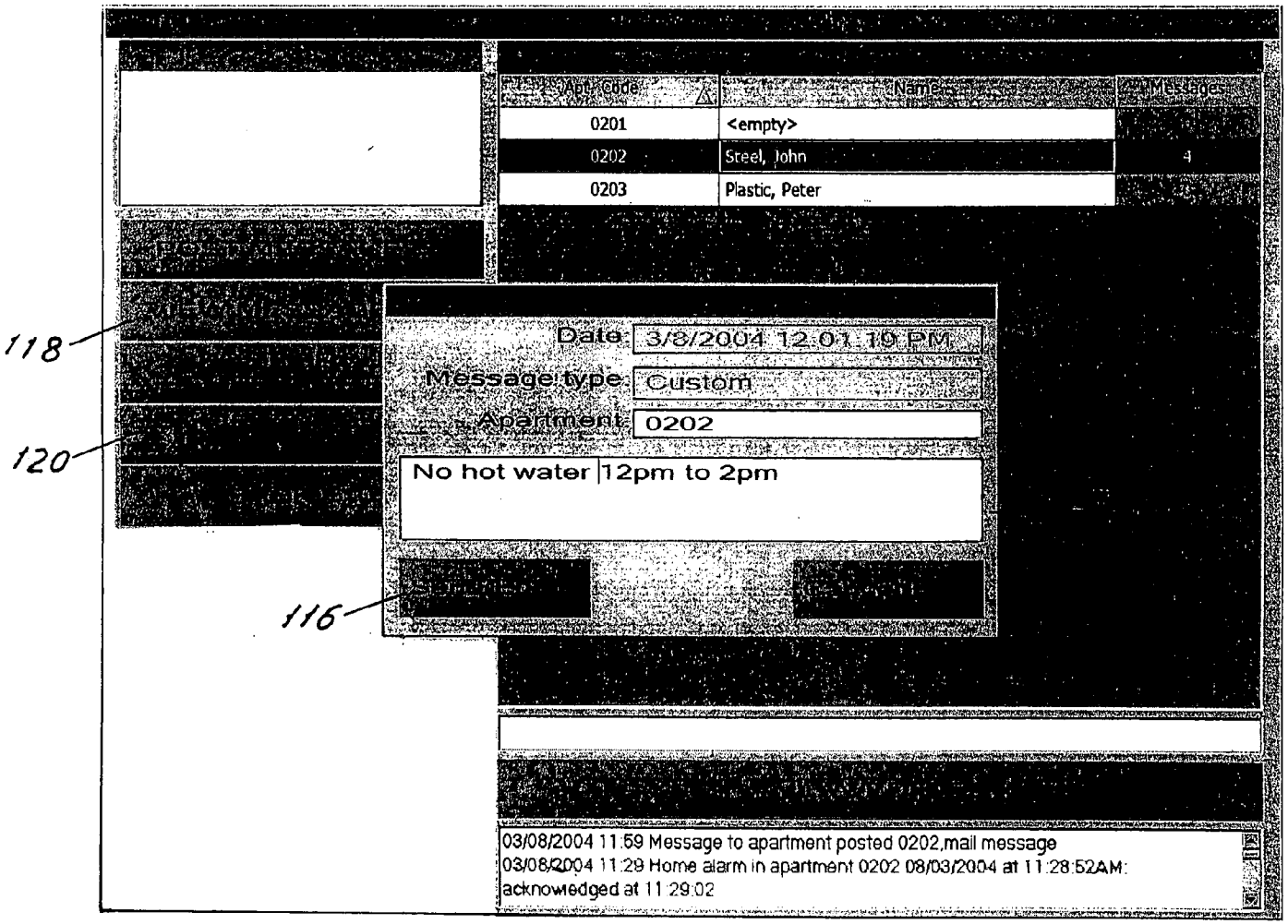

Referring back to FIG. 8, by clicking on Message button 110 after highlighting the name of a user, a dialog box 112 appears, as shown in FIG. 10. Dialog box 112 includes a message box 114 in which a message can be composed, and then sent to the selected user by clicking on Send button 116.

According to another aspect of the present invention a user interface 16 may be equipped with an electronic memory device that can receive a text message and store the same for future viewing by a user. Referring, for example, to FIG. 4B, by pressing Message button 22B on control panel 22, a user may retrieve the stored messages.

According to another aspect of the present invention, text messages may be sent to a selected group of user interfaces 16. Thus, for example, as shown in FIG. 10, the operator of central communication unit 50 can compose a message and send the same to a group of user interfaces 16 by clicking on Post Group Messages. Although not shown, a dialog box similar to the one shown in FIG. 10 will appear in response to allow the operator to compose a message for the group.

According to another aspect of the present invention, messages that are sent to a user can be retrieved and viewed by highlighting the user's name and clicking on View Messages button 118. Same can be accomplished for a group by clicking on View Group Messages button 120.

It should be noted that a system according to the present invention can keep track of all outstanding messages for each user. Thus, as shown in FIG. 8, the listing of users includes the number of messages sent to each user. For example, FIG. 8 shows that John Steel has three (3) outstanding messages. As explained above, these messages can be retrieved by the operator of the central communication unit 50 and delivered in person, for example, when the user enters the building and passes by the operator. This feature provides for additional convenience for the users. For example, if the message says that there is a package the user does not need to go to his/her residential unit, pick up the message, and return to retrieve the package.

According to another aspect of the present invention, the operator of the central communication unit 50 can send a signal to sound an emergency alarm through the audio communication system 18 of any one user interface 16, or any selected group of user interfaces. The alarm may be accompanied with a textual message. The textual message may be composed in a dialog box (similar to the one shown in FIG. 10) and sent to a user interface 16 or a selected group of user interfaces 16. The textual message may be, for example, evacuation instructions.

It should be noted that according to the present invention the alarm is sounded inside each residential unit 14 through a user interface 16. This feature is unlike prior art systems in which the alarm is placed outside the residential units 14 in, for example, hallways.

A system according to the present invention further includes an audio announciation feature. An announciation feature according to the present invention allows an operator of central communication unit 50 to announce an audio message through one user interface or a selected group of user interfaces. Thus, for example, in case of an emergency, an audio message may be announced through a group of user interfaces 16. The announcement may be made by the operator of central communication unit 50. Announcing messages through user interfaces is advantageous over the prior art which includes announciation equipment in hallways. For example, in case of an emergency which may require the users to stay indoors, a system according to the present invention prevents the exposure of users to the danger of stepping outside in the hallway just to listen to the announcement.

Figure 11:
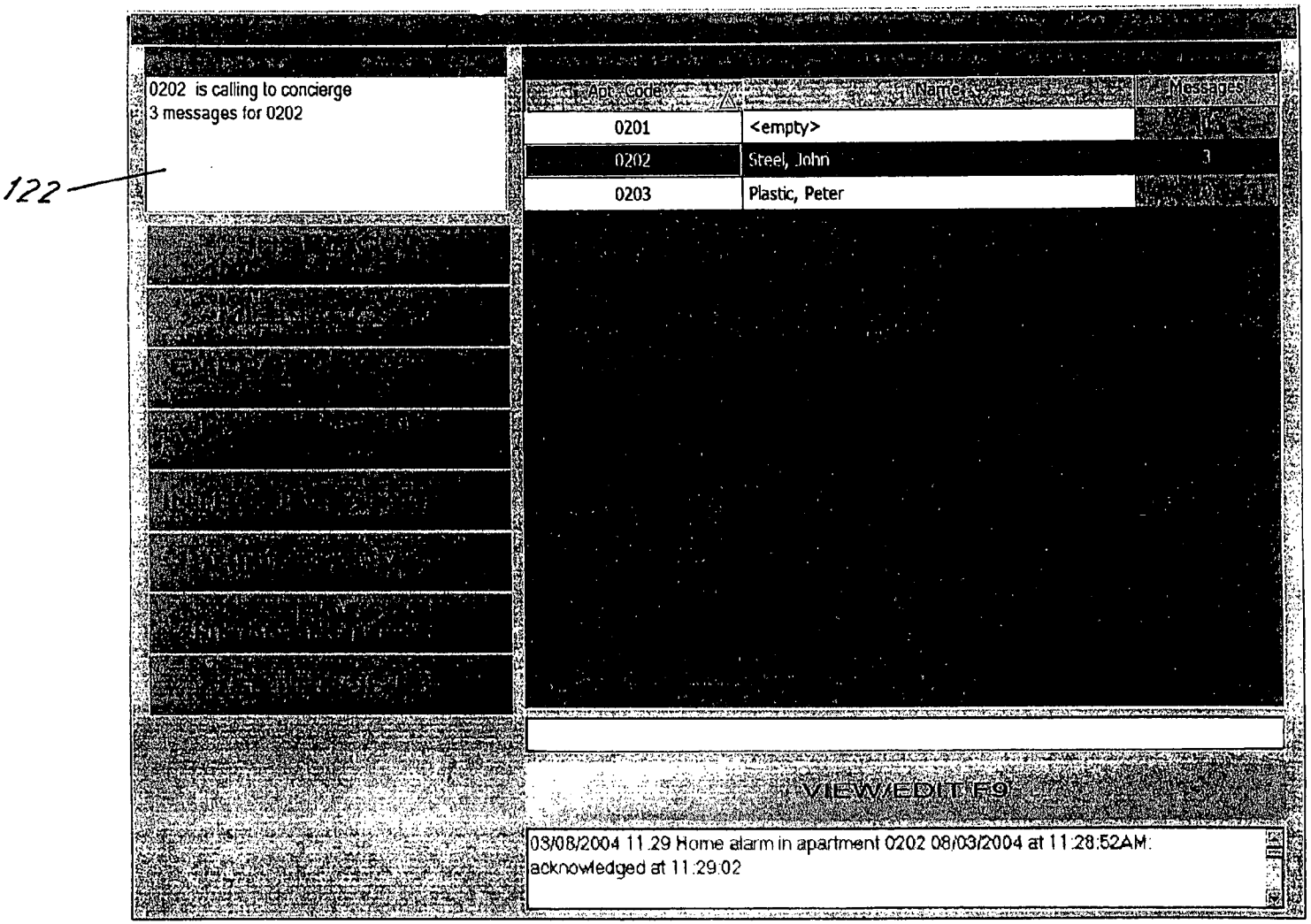

According to another aspect of the present invention, a user may attempt to establish contact with the operator of central communication unit 50 by, for example, pressing and releasing Call key 22J on keyboard panel 22. If operator of central communication unit 50 is busy, user interface 16 sounds off a busy signal. However, as shown in FIG. 11, a Call Box 122 is provided for the operator of central communication unit 50 in which it is indicated that a user is attempting to make contact. Thus, the operator can return the call to the user at the first convenient moment without the user having to call repeatedly until he can reach the operator of central communication unit 50.

According to another aspect of the present invention each user panel is capable of sending textual messages to central communication station 50. Such messages may then be viewed by the operator of the central communication station 50. For the purpose of sending text messages, keyboard panel 22 of a user interface may be equipped with appropriate keys, each of which can be associated with a preselected message.

Figure 12:
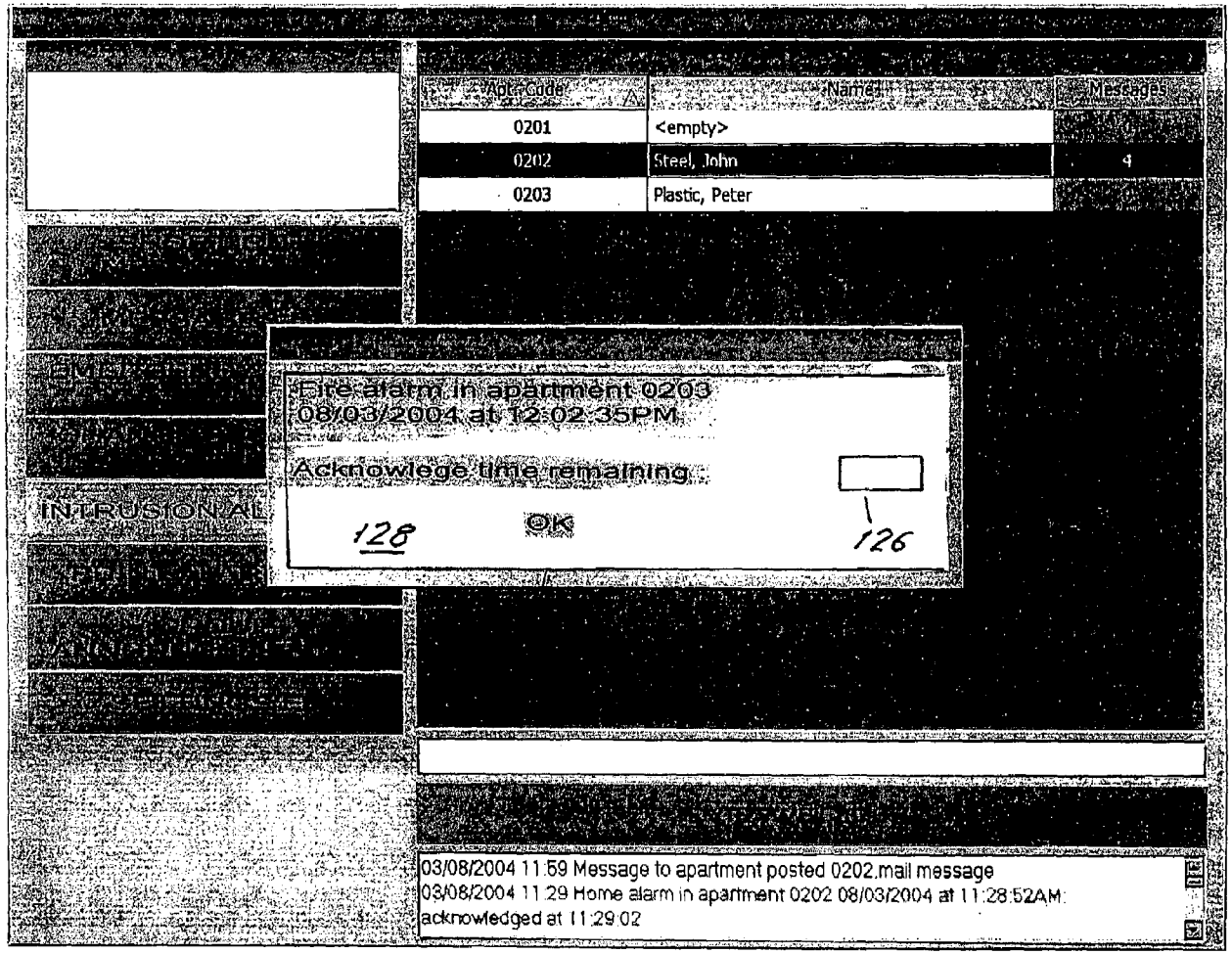

Referring, for example, to FIG. 4B keyboard panel 22 can include a key for requesting a taxi 22C, reporting an emergency 22D, reporting a security breach 22E, and reporting a fire 22F. For example, when a key for reporting a fire 22F is pressed, a message box 124 such as the one shown in FIG. 12 is sent to the operator of central communication unit 50 to apprise him/her of the fire. The message box 124 is accompanied by an audio alarm to get the attention of the operator. Message box 124 includes a timer box 126 which counts the time as it elapses until the operator of the central communication unit 50 acknowledges the receipt of the message by clicking on the OK button 128. Once the OK button 128 is clicked the alarm sound is turned off, and a signal is sent back to user interface 16 that sent the fire signal to indicate that the message has been received.

According to an aspect of the present invention, each key causes the creation of a unique sound. For example, reporting a fire key 22F sounds like a fire alarm, security breach key 22E sounds like a police siren etc. The reason for the differing sounds is to indicate to the operator the nature of the message using an audio signal before he/she reads the text message.

A keyboard panel 22 may also include keys for mode selection. For example, control panel 22 shown in FIG. 4B includes home key 22G to indicate to the system that the user is home. This mode secures the perimeter of the residential unit when user is at home. Thus, if an intruder enters the residential unit, an appropriate message is sent to the operator of the central communication unit 50.

When away key 22H is pressed the user is given a pre-determined amount of time to exit the residential unit. Once the user exits, the intruder alarm system is enabled. Thereafter, once somebody enters the residential unit the intruder alarm sends a message to the operator of the central communication unit 50 unless an appropriate code is entered to disarm the alarm.

According to another aspect of the present invention a special duress code may be entered into the user interface 16. A duress code will cause the user interface to visually appear to have been disarmed. However, in reality it causes the user interface to send a duress message to the operator of the central communication unit 50. Such a feature is helpful when, for example, an intruder is forcing the user to enter a code to disarm the intruder alarm in that it allows the user to alert the operator without the intruder knowing.

According to another aspect of the present invention, the code for disarming the intruder alarm may be changed by the user without changing the hardware of user interface 16. To do so, the operator of central communication unit 50 sends a signal to the user. The signal is announced with an audio output. Once the audio signal is received the user may input a new code using the number keys on keyboard panel 22, which will replace the old code. As a result, a user may set the code without the intervention and knowledge of a third party. This enhances security.

Figure 13:
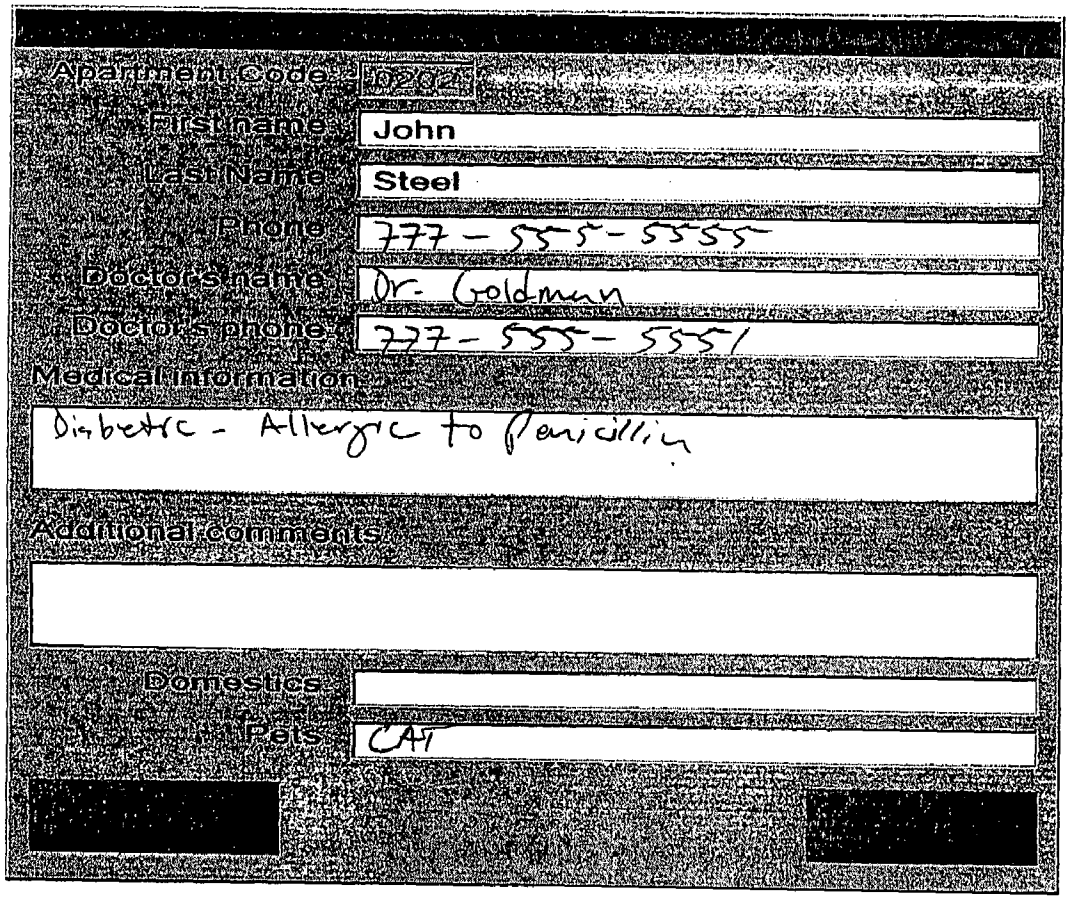

According to an aspect of the present invention when key for reporting an emergency 22D is pressed, pre-recorded user information such as the user's preferred emergency contact information and doctor information may be transmitted to central communication unit 50 automatically. An example of a screen showing such information is shown in FIG. 13. This information may be updated by the administrator of the system.

Further, central communication unit 50 may include an electronic memory storage for storing at least the names and unit numbers for each user, as well as information relating to authorization for keyless entry. Such information is preferably updateable at central communication unit 50 so that information used to allow access through keyless entry system 41, and information displayed by electronic display 46 can be kept up-to-date. In addition to information relating to authorization of entry, the time of entry may also be restricted. Thus, for example, a keyless reader may be installed at the gym and then time of entry may be restricted. Or, a keyless device such as a card may be given to a mailman to enter the building but not to be able to use the gym. It should be noted that unlike prior art systems the keyless entry is integrated with and managed through central communication unit 50.

A system according to the present invention records and retains the time of keyless entry for every user at every location where a keyless reader is located.

Moreover, central communication unit 50 may receive automatically signals from the peripheral devices associated with each user interface 16. For example, in the preferred embodiment of the present invention, central communication unit 50 can receive signals from intrusion alarm 26 or smoke detector 24 so that the operator of the central communication unit 50 can take an appropriate action.

In the preferred embodiment an intrusion alarm 26 may send signals to remote communication unit 10 in all modes, e.g., home mode, away mode, or duress mode.

In an embodiment, a user may send a special code to central communication unit 50 or remote communication unit 10 to indicate that there has been an actual intrusion. Such a feature may be enabled after receiving an authorization signal, such as audio authorization signal, from a user.

According to one aspect of the present invention central communication unit 50 is in communication with remote communication unit 10, whereby remote communication unit 10 can be employed to perform the following:

- change or update user information including user name and user unit number and keyless authorization;
- perform diagnostics on all aspects of local integrated intercom and security system 8;
- perform diagnostics on all user interface 16 units automatically without prior request from a user or upon request from a user;
- send, check and delete text messages to one user interface 16 or a selected group of user interfaces 16;
- update authorization information of keyless entry (e.g. authorize or cancel access to an individual user).

Remote communication unit is not required for performing the foregoing function. The foregoing functions can be performed through central communication unit 50 as well.

In addition, each user interface 16 as used in a system according to the present invention can perform the following:

- display at least four views in visual display 20;
- display views of not only the area at the vicinity of front door 38, but also hallway 34 near front door 38 through camera 30 to ensure, for example, a visitor is properly following path to user's unit;
- display view of all zones in which a camera 30 is installed to allow user (not just the operator of central communication unit 50) to view areas such as the laundry room 36, etc.

In addition, a system according to the present invention is enabled for video messaging. Thus, a video message may be sent by remote communication unit 10 and received at a visual display 20.

Furthermore, a user interface 16 can be in communication with a wireless device through which a user can announce an emergency to the operator of central communication unit 50 and a mobile telephone. The wireless device may be a wireless pendant worn by, for example, an elderly user who may require emergency assistance. In response to a signal received from such a device, the operator of central communication unit 50 can contact the user using the audio announciation feature and have an audio communication through two-way audio communication system 18. When contacting the user in this mode of operation preferably the audio volume is raised automatically so that the user can be heard from a location remote to user interface 16. In this mode, the operator of the cell phone who has just received a signal from the user's wireless emergency device can also contact the user through user interface 16 by using a special code.

According to another aspect of the invention users can communicate with one another in groups or individually through the user interfaces 16.

According to an alternative embodiment of the present invention more than one central communication unit 50 may be provided in the same residential complex.

According to another aspect of the present invention, a keyboard may be provided along with electronic directory 46. The keyboard can be used by a user to enter a code to enter the building without using the keyless entry system. The code in the preferred embodiment may be the combination of the user's residential unit number and a secret code.

According to another aspect of the present invention, a user may be able to receive his/her message posted in the system through a public communication service such as the world wide web. Thus, the message may be posted on a web site so that they may be viewed by a user.

According to another aspect of the present invention, a visitor can record an audio and/or video message for a user for later retrieval. Specifically, a user interface is equipped with an electronic memory device to record such messages from a visitor in the event the user is not home. The message may be recorded through the surveillance camera 42 and audio communication system installed alongside of electronic directory 46 where it can be accessible to the public.

According to another aspect of the present invention, alarms such as intruder alarms and fire alarms can be directed to a telephone outside the system. Thus, for example, an alarm along with a text message may be sent to a user's mobile telephone automatically.

Furthermore, a system according to the present invention includes an automatic self-diagnostic system that periodically performs diagnostics on the all the equipment within the system. Thus, a system according to the present invention is capable of detecting and reporting problems before a user even becomes aware of the problem.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An integrated intercom and security system comprising:

- a local integrated intercom and security system, said local system including,
  - a first plurality of user interfaces each user interface associated with a dwelling and including a two-way audio communication system and a visual display;
  - a second plurality of user interfaces each user interface associated with a dwelling and including a two-way audio communication system and a visual display;
  - a first riser connecting said first plurality of user interfaces;
  - a second riser connecting said second plurality of user interfaces;
  - a central communication station operatively connected to said first and second risers and in communication with all of said user interfaces; wherein said central communication station is capable of sending text message to one, to all or to a selected group of said user interfaces; and
  - a remote communication unit in real time communication with said local system via a globally accessible communication network.

2. An integrated intercom and security system according to claim 1, wherein said remote communication unit is capable of communicating with said local system for the purpose of performing diagnostics.

3. An integrated intercom and security system according to claim 1, wherein said remote communication unit is capable of sending messages to said user interfaces.

4. An integrated intercom and security system according to claim 3, wherein said remote communication unit is capable of sending messages to a selected one of said user interfaces.

5. An integrated intercom and security system according to claim 3, wherein said remote communication unit is capable of sending messages to a selected number of said user interfaces.

6. An integrated intercom and security system according to claim 1, wherein each user interface includes a feature for storing messages.

7. An integrated intercom and security system according to claim 1, wherein said messages are textual.

8. An integrated intercom and security system according to claim 1, wherein each said user interface is capable of sending a message to said central communication unit.

9. An integrated intercom and security system according to claim 8, wherein said message is an audio message.

10. An integrated intercom and security system according to claim 8, wherein said message is a textual message.

11. An integrated intercom and security system according to claim 8, wherein said message includes a request for a service.

12. An integrated intercom and security system according to claim 8, wherein each said user interface includes a feature for sending an emergency message to said central communication unit, and further comprising a feature for sending auxiliary information along with said emergency message.

13. An integrated intercom and security system according to claim 12, wherein said auxiliary information includes a name of a contact person.

14. An integrated intercom and security system according to claim 1, further comprising at least one peripheral device in communication with each of said user interfaces.

15. An integrated intercom and security system according to claim 14, wherein said peripheral device is a smoke detector.

16. An integrated intercom and security system according to claim 15, wherein said central communication unit is adapted to receive a message from each smoke detector associated with each user interface.

17. An integrated intercom and security system according to claim 14, wherein said peripheral device is an intrusion alarm.

18. An integrated intercom and security system according to claim 17, wherein said central communication unit is adapted to receive a message from each intrusion associated with each user interface.

19. An integrated intercom and security system according to claim 1, further comprising a feature for video messaging.

20. An integrated intercom and security system comprising:

a first plurality of user interfaces each user interface associated with a residential unit, and each said user interface including a two-way audio communication system and a visual display;

a second plurality of user interfaces each user interface associated with a residential unit, and each said user interface including a two-way audio communication system and a visual display;

a first riser connecting said first plurality of user interfaces;

a second riser connecting said second plurality of user interfaces;

a security system operatively connected to each of said user interface, said security system including, a plurality of cameras, each camera being disposed to capture images from a distinct zone;

a remote door lock, said door being adapted to open upon receiving a message from a user interface; and an electronic directory, said electronic directory including a public display feature for displaying information, wherein said information displayable by said public display is limited to names associated with each unit;

wherein each user interface is operatively connected to each of said cameras to receive images from each said zone.

21. An integrated intercom and security system according to claim 20, wherein each visual display in each user interface is capable of displaying images from more than one zone.

22. An integrated intercom and security system according to claim 20, wherein each visual display in each user interface is capable of displaying images from up to four zones.

* * * * *